US006433468B1

(12) United States Patent
Shinoda

(10) Patent No.: US 6,433,468 B1
(45) Date of Patent: Aug. 13, 2002

(54) COLOR SELECTION MECHANISM AND COLOR CATHODE-RAY TUBE

(75) Inventor: Masaki Shinoda, Aichi (JP)

(73) Assignee: Sony Corporation (JP)

( * ) Notice: Subject to any disclaimer, the term of this patent is extended or adjusted under 35 U.S.C. 154(b) by 155 days.

(21) Appl. No.: 09/596,042

(22) Filed: Jun. 16, 2000

(30) Foreign Application Priority Data

Jun. 16, 1999 (JP) ..... 11-169055

(51) Int. Cl.[7] ..... H01J 29/07
(52) U.S. Cl. ..... 313/403
(58) Field of Search ..... 313/402, 403, 313/407

(56) References Cited

U.S. PATENT DOCUMENTS 5,396,145 A * 3/1995 Shiohara et al. ..... 313/403 X
5,583,391 A * 12/1996 Good et al. ..... 313/402

* cited by examiner

*Primary Examiner*—Ashok Patel
(74) *Attorney, Agent, or Firm*—Rader, Fishman & Grauer PLLC; Ronald P. Kananen, Esq.

(57) ABSTRACT

Disclosed is a color-selection mechanism with an aperture-grill type, color-selection electrode which includes tapes and slits that are disposed between the tapes. In this mechanism, when the arranged pitch of the slits is in the range of 0.310 to 0.221 mm, the width of the flat portion on the panel side of each tape of the color selection electrode is set to be 0.215 to 0.050 times the slit pitch, which is narrower than that in the related art, and when the arranged pitch of the slits is in the range of 0.220 to 0.100 mm, the width of the flat portion on the panel side of each tape of the color selection electrode is set to be 0.225 to 0.050 times the slit pitch, which is narrower than that in the related art. With this configuration, the amount of reflection of an electron beam that has been reflected from the inner surface of the panel from the flat portion on the panel side of each tape to an undesired phosphor can be reduced. As a result, the degradation of color purity in a CRT can be reduced.

6 Claims, 6 Drawing Sheets

COLOR SELECTION MECHANISM AND COLOR CATHODE-RAY TUBE

BACKGROUND OF THE INVENTION

The present invention relates to an aperture-grill type, color-selection mechanism and a color cathode-ray tube using the color-selection mechanism.

A color cathode-ray tube used for a television receiver, a display for a monitor of a computer and the like has a structure as shown in FIG. 1. In this figure, reference numeral 1 designates a panel, 2 is a color selection electrode, 3 is a phosphor, 4 is a funnel, and 5 is an electron gun. FIG. 2 is a perspective view showing an aperture-grill type, color-selection electrode 2, which includes tapes 6, slits 7, and a frame 8. FIG. 3 is a sectional view showing a panel 1 and a color selection electrode 2 of a related art color cathode-ray tube.

Referring to FIG. 3, an electron beam 9 emitted from an electron gun passes through one slit 7 of the color-selection electrode 2 and further through an aluminum film 10, and it collides with a phosphor 3*a* to make phosphor 3*a* luminous.

The color-selection electrode 2 is generally produced by forming a patterned mask film on the surface of a steel sheet having a specific thickness and etching the steel sheet using the mask film as a mask to form a large number of slits 7, each of which extends in a stripe-shape between adjacent tapes 6. Each tape 6 has the cross-sectional shape shown in FIG. 3, in which the width of the portion on the electron gun side of tape 6 is different from the width of the portion on the panel side, of the tape 6, and, more specifically, the width of the flat portion 6*a*, nearest to the panel side of tape 6 is narrowest.

To be more specific, the cross-sectional shape of the tape 6 is designed such that a portion on the electron gun side, which is in a thickness range being several tens percent of the total thickness of the tape 6, has a width which is constant and widest, the flat portion 6*a* nearest to the panel side has the narrowest width, and a portion therebetween has a width which becomes narrower when nearing to the panel side. Reference numeral 6*c* designates a tilt portion formed by making the width of the tape 6 narrower toward the panel side. The reason why each tape 6 has such a cross-sectional shape is that the electron beam 9 (generally, electron beam for red or blue), having obliquely passed through the slit 7, is allowed to be made incident on the corresponding phosphor 3*a* as much as possible while not being shielded by the tapes 6 positioned on both sides of the slit 7.

According to the related art color-selection electrode 2, with the arranged pitch of slits (hereinafter referred to as "a slit pitch") set in a range of 0.310 to 0.221 mm, the width of the flat portion 6*a* nearest to the panel side of tape 6 is set to be 0.25 to 0.30 times the slit pitch.

By the way, the related art color cathode-ray tube has the problem that it is difficult to improve the color purity. The reason for this is as follows: namely, a color cathode-ray tube used for a display obtaining a high-definition image quality requires a finer arranged pitch of slits; however, such a finer arranged pitch of slit causes the phenomenon that electrons having collided with a desired phosphor are partially reflected therefrom and scattered, and the scattered electrons collide with an undesired phosphor to make the undesired phosphor luminous.

To be more specific, as shown in FIG. 3, when the electron beam 9, having obliquely passed through one slit 7, collides with the corresponding phosphor 3*a*, all of the beam 9 having thus collided with the phosphor 3*a* is not necessarily made incident on the phosphor 3*a*; that is, it does not necessarily contribute to generation of luminescence of the phosphor 3*a*. That is to say, there may occur the phenomenon that part 9*a* of the electron beam 9 is reflected from the phosphor 3*a* and collides with the flat portion 6*a* on the panel side of tape 6 of the color selection electrode 2, and the electron beam 9*a* having thus collided with the flat portion 6*a* is scattered, and part of the scattered beam is made incident on an undesired phosphor 3*b* to generate luminescence of the undesired phosphor 3*b*. As a result, a color mixture occurs, and thereby the color purity is degraded.

An effort has been directed to make the color deviation due to reflection of an electron beam as small as possible by improving the materials of the phosphors 3 and the color selection electrode 2; however, at the present condition, the requirement toward improvement of the color purity has been made larger, and it has been difficult to meet such a requirement.

The related art color-selection mechanism has another problem that the color purity is uneven between a central portion of the screen and right and left sides thereof because the tilt angle at which an electron beam collides with a phosphor differs between the central portion of the screen and the right and left sides thereof.

To be more specific, the electron beam 9 emitted from an electron gun passes through one slit 7 of the color selection electrode 2, and part of the electron beam 9 is reflected from the aluminum film 10 and the phosphor 3; and, it is known that the reflectance of the electron beam differs depending on the tilt angle at which the electron beam 9 collides with the aluminum film 10 and the phosphor 3, and, more specifically, the reflectance of the electron beam 9 becomes larger as the above tilt angle becomes larger. On the other hand, as described above, the tilt angle at which the electron beam collides with the aluminum film 10 and the phosphor 3 differs between the central portion of the screen of the color cathode-ray tube and the right and left sides thereof. As a result, unevenness of the color purity occurs due to the difference in reflectance among positions in the horizontal scanning direction on the screen.

The present inventor has found that the evenness of the color impurity on the screen can be obtained by suitably changing the width of the flat portion 6*a*, on the panel side of each tape of the color selection mechanism in accordance with the tilt angle at which an electron beam collides with the aluminum film 10 and the phosphor 3. As the result of examining the change in width of the flat portion 6*a* on the panel side of each tape of the related art color selection mechanism depending on the position on the horizontal scanning direction, it was found that the above width is changed as shown by the data ("related art") in FIG. 6.

The present inventor has repeatedly made experiments and found that the evenness of color purity can be significantly enhanced by changing the above width as shown by the data ("present invention (third embodiment)") in FIG. 6, and has accomplished a third invention to be described later on the basis of such knowledge.

SUMMARY OF THE INVENTION

The first object of the present invention is to provide a color-selection mechanism capable of suppressing the degradation of color purity due to the fact that an electron beam, which has passed through a slit and has been reflected from the inner surface of a panel, is reflected from a surface on the panel side of each tape of a color-selection electrode and is made incident on another phosphor different from a desired phosphor, and to provide a color cathode-ray tube using the color-selection mechanism.

The second object of the present invention is to provide a color-selection mechanism capable of reducing the unevenness of color purity caused depending on the position in the horizontal scanning direction on the screen and to provide a color cathode-ray tube using the color-selection mechanism.

According to a first aspect of the present invention, there is provided a color-selection mechanism with an aperture-grill type, color-selection electrode which includes tapes constituting the matrix of the electrode and slits each that are disposed between the tapes, the arranged pitch of the slits are in the range of 0.310 to 0.221 mm, and wherein the width of a flat portion on the panel side of each tape of the color selection electrode is set to be 0.215 to 0.050 times the slit pitch, and a color cathode-ray tube using the color-selection mechanism.

With this configuration, the width of the flat portion on the panel side of each tape is set to be 0.215 to 0.050 times the slit pitch, which is narrower than that in the related art. As a result, it is possible to reduce the amount of re-reflection of an electron beam that has been reflected from the inner surface of the panel from the flat portion on the panel side of each tape to an undesired phosphor, and hence to reduce the degradation of color purity.

According to a second aspect of the present invention, there is provided a color selection mechanism with an aperture-grill type, color-selection electrode which includes tapes constituting the matrix of the electrode and slits that are disposed between the tapes, the arranged pitch of the slits are in the range of 0.220 to 0.100 mm, and wherein the width of the flat portion on the panel side of each tape of the color selection electrode is set to be 0.225 to 0.050 times the slit pitch, and a color cathode-ray tube using the color-selection mechanism.

With this configuration, the width of the flat portion on the panel side of each tape is set to be 0.220 to 0.050 times the slit pitch, which is narrower than that in the related art. As a result, it is possible to reduce the amount of re-reflection of an electron beam that has been reflected from the inner surface of the panel from the flat portion on the panel side of each tape to an undesired phosphor, and hence to reduce the degradation of color purity.

According to a third aspect of the present invention, there is provided a color-selection mechanism with an aperture-grill type color-selection electrode which includes tapes constituting the matrix of the electrode and slits that are disposed between the tapes, and wherein the ratio of the width of the flat portion on the panel side of each of the tapes at the central portion of the screen to the width of the flat portion at each end of the screen is 1:1.5–0.3 and the width of the flat portion is gradually changed from the central portion of the screen to each end of the screen, and color cathode-ray tube using the color selection mechanism.

With this configuration, since the distribution of widths of the flat portions on the panel side of the tapes in the horizontal scanning direction of the screen conforms to an experimentally-obtained distribution in which the evenness of color purity can be significantly enhanced, it is possible to significantly enhance the evenness of color purity.

DETAILED DESCRIPTION OF THE PREFERRED EMBODIMENTS

Prior to describing the preferred embodiments, a basic configuration of the present invention will be described below. According to the present invention, to enhance the color purity, when the slit pitch of a color selection electrode is in a range of 0.310 to 0.221 mm, the width of a flat portion on the panel side, of each tape is set to be 0.215 to 0.050 times the slit pitch, and when the slit pitch is in a range of 0.220 to 0.100 mm, the above width is set to be 0.225 to 0.050 times the slit pitch.

Further, to enhance the evenness of color purity, a ratio of the width of the flat portion on the panel side of each of the tapes at the central portion of a screen to the width of the flat portion at each end of the screen is 1:1.5–0.3, and the width of the flat portion is gradually changed from the central portion of the screen to each end of the screen.

Hereinafter, embodiments of the present invention will be described with reference to the drawings.

[First Embodiment]

Figure 4:
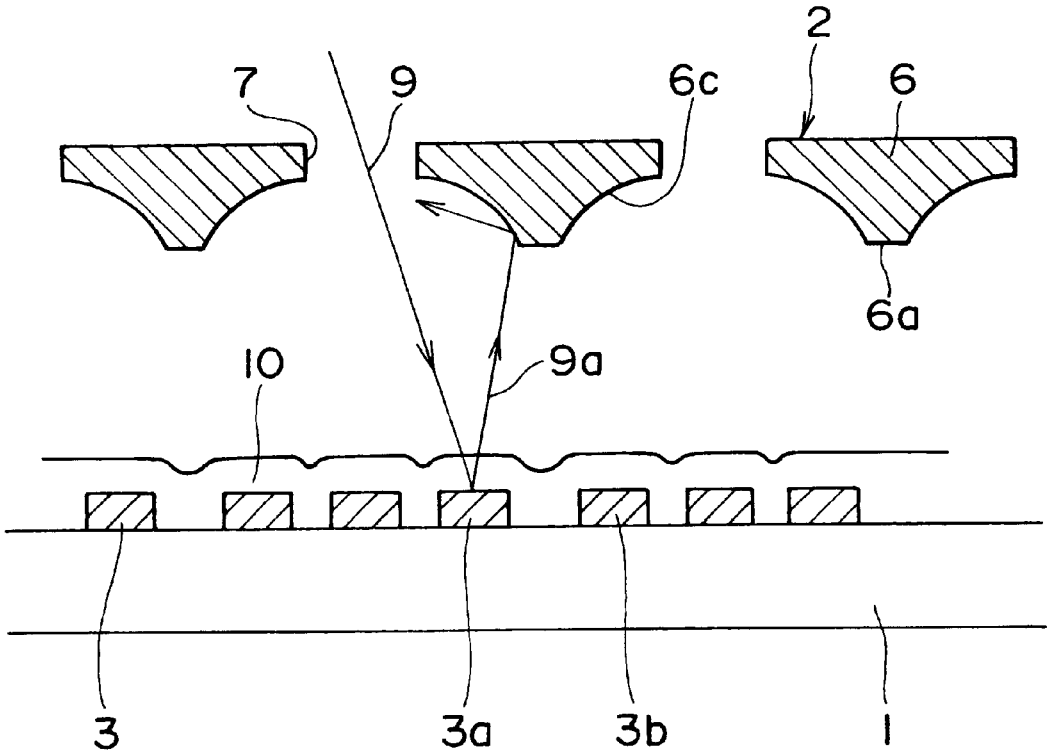
FIG. 4 is a horizontal sectional view of a color cathode-ray tube showing an essential portion of the first embodiment of the present invention.

FIG. 4 is a horizontal sectional view of a color cathode-ray tube showing an essential portion of the first embodiment of the present invention. In this figure, reference numeral 1 designates a panel, 2 is a color selection electrode, 3 is a phosphor formed on the inner surface of the panel 1, 6 is a tape of the color-selection electrode 2, and **6*a* is a flat portion on the panel side of tape 6**.

The color selection electrode 2 is produced by forming a patterned mask on the surface of a steel sheet having a specific thickness and etching the steel sheet using the mask film as a mask to form a large number of slits 7, each of which extends in a stripe-shape between adjacent tapes 6. Each tape 6 has the cross-sectional shape shown in FIG. 4, in which the width of the portion on the electron gun side of tape 6 is different from the width of the portion on the panel side of tape 6, and more specifically, the width of the flat portion **6*a* nearest to the panel side of tape 6 is narrowest. In the embodiment of the present invention, the arranged pitch of the slits 7 is in a range of 0.310 to 0.221 mm. In addition, reference numeral 10 designates an aluminum film formed on the inner surface of the panel 1**.

Figure 1:
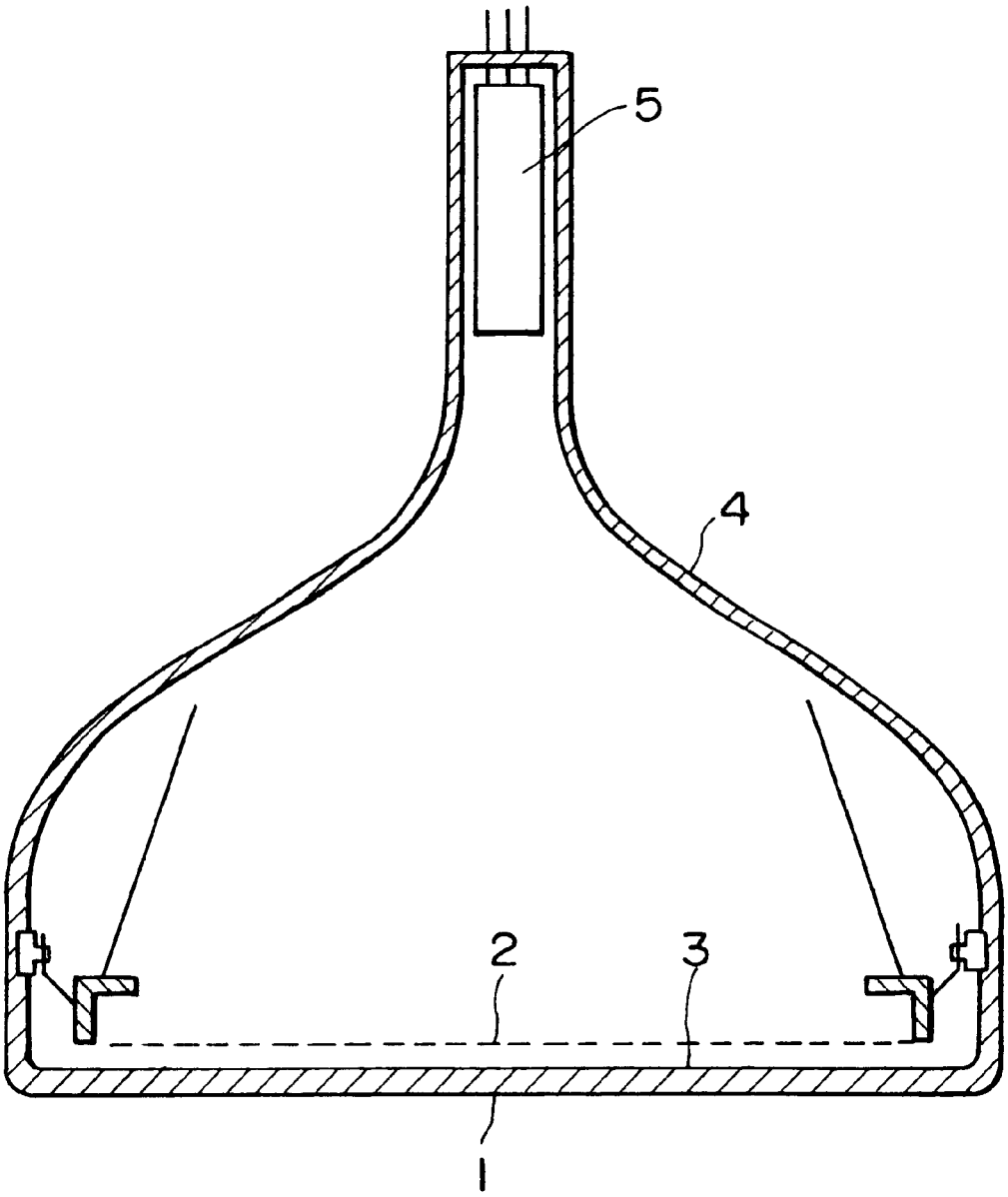
FIG. 1 is a horizontal sectional view of a color cathode-ray tube.
Figure 2:
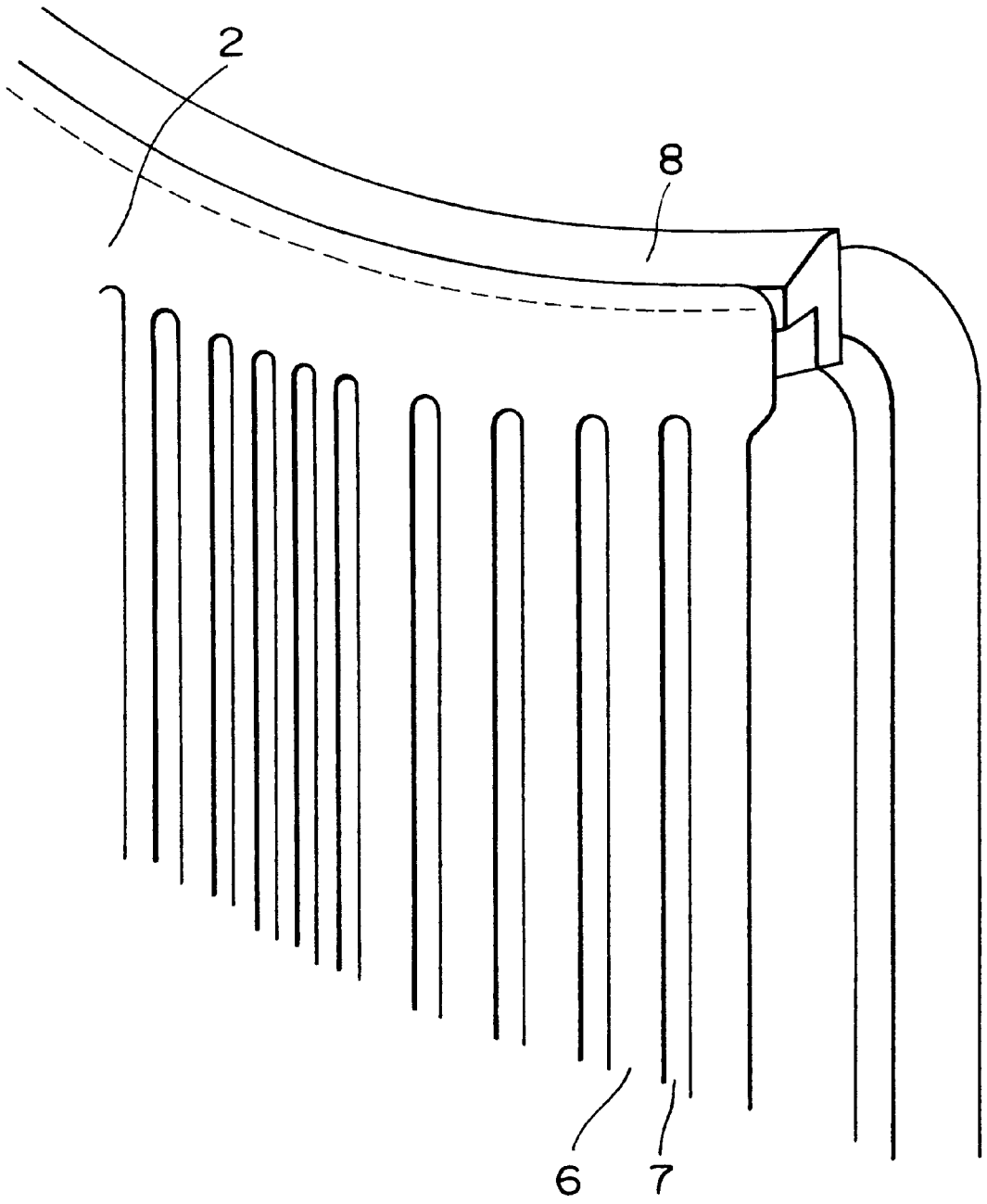
FIG. 2 is a perspective view showing an essential portion of a color-selection mechanism.
Figure 3:
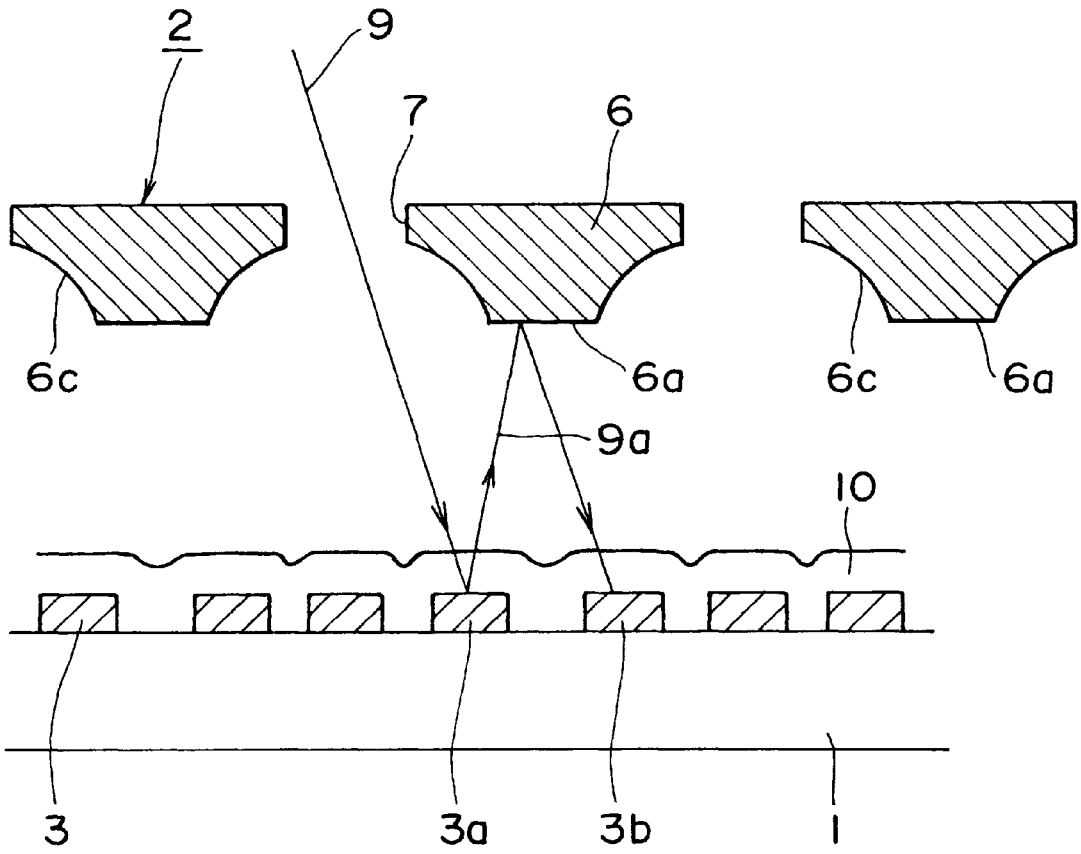
FIG. 3 is a horizontal sectional view of a color cathode-ray tube showing an essential portion of a related art.

The embodiment shown in FIG. 4 is different from the related art shown in FIG. 3 in that the width of the flat portion on the panel side of each tape is set to be 0.215 to 0.050 times the slit pitch, which is much smaller than the width set to be 0.225 to 0.30 times the slit pitch in the related art.

Even in this embodiment, as shown in FIG. 4, an electron beam 9 emitted from the electron gun 5 passes through one slit 7 of the color selection electrode 2 and further through the aluminum film 10, and collides with a phosphor 3*a* to make phosphor 3*a* luminous. At this time, several percent of the electron beam 9 is reflected from the aluminum film 10 and the phosphor 3*a*, and part of the reflected electron beam 9*a* is reflected again from the flat portion 6*a* on the panel side of tape 6 and is made incident on another phosphor 3*b*. As a result, a color mixture occurs, and thereby the color purity is slightly degraded. Such a phenomenon cannot be essentially avoided even in this embodiment.

In this embodiment, however, since the width of the flat portion 6*a* on the panel side of tape 6, from which the electron beam 9*a* having been reflected from the aluminum film 10 and the phosphor 3 of the panel 1 is reflected, is narrower than that in the related art, the amount of reflection of the electron beam 9*a* from the flat portion 6*a* on the panel side of tape 6 to the undesired phosphor 3*b* becomes correspondingly smaller than that in the related art.

Accordingly, the undesired phosphor 3*b* at which the electron beam has arrived emits light of a color different from that of the light emitted from the desired phosphor 3*a*, and thereby the color purity is degraded; however, since the amount of the electron beam having arrived at the undesired phosphor 3*b* becomes smaller than that in the related art, the luminance of the light emitted from the undesired phosphor 3*b* becomes correspondingly smaller than that in the related art. As a result, according to this embodiment, the degree of the color mixture becomes smaller than that in the related art, and thereby the degradation degree of the color picture become much smaller than that in the related art.

In addition, since the flat portion 6*a* on the panel side of tape 6 of the color-selection electrode 2 is made narrow, the area of the tilt portion 6*c* becomes correspondingly larger, and thereby the amount of collision of the electron beam with this portion 6*c* becomes larger. However, since the angle of the tilt portion 6*c* is not an angle at which light is reflected from portion 6*c* to the undesired phosphor 3*b*, the increased area of the tilt portion 6*c* does not bring a color mixture, thereby not degrading the color purity.

Figure 5:
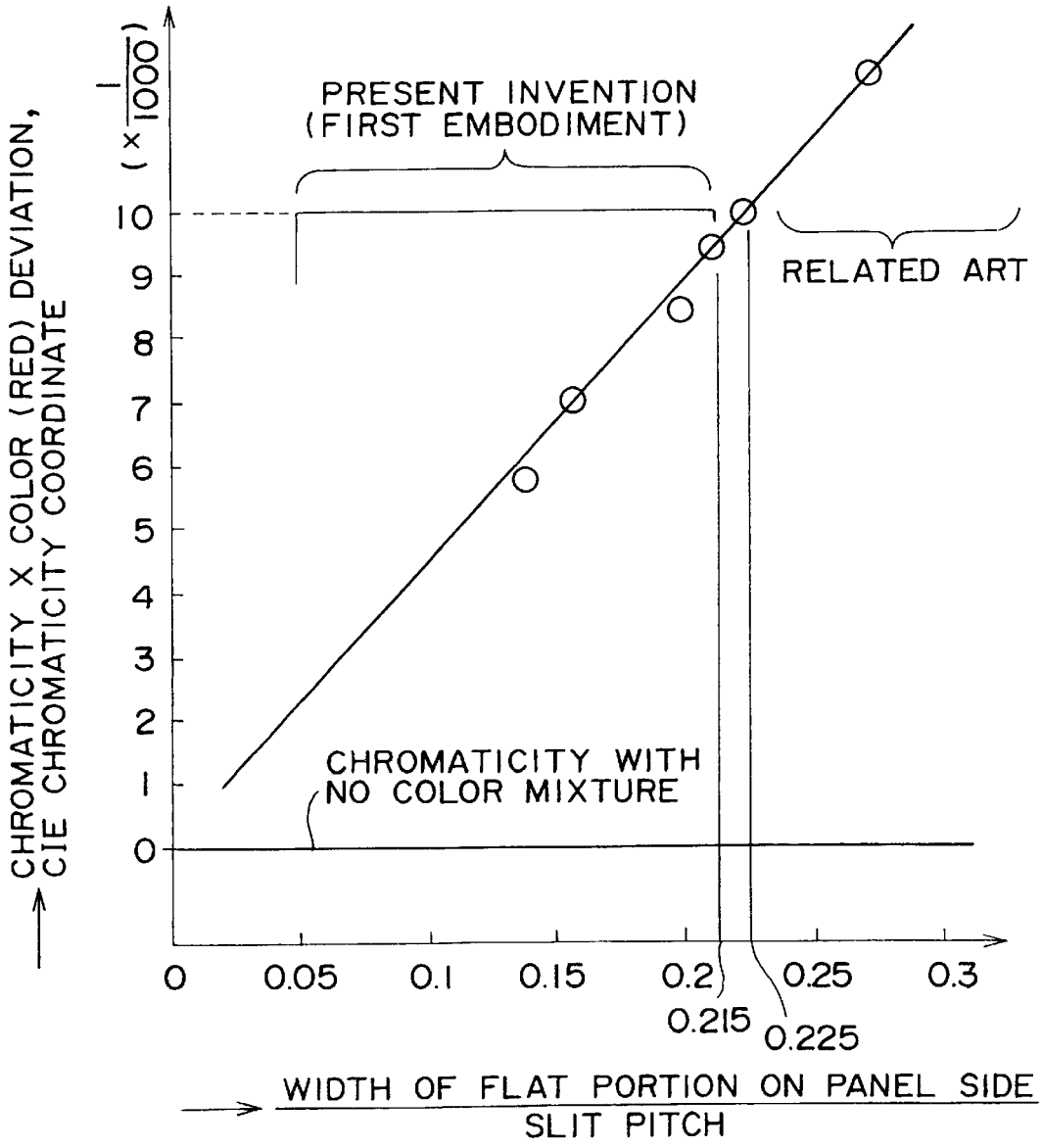
FIG. 5 is a diagram showing the relationship between the ratio of width/slit pitch at the flat portion on the panel side of a tape (indicated on the abscissa) and the degradation degree of chromaticity of red (indicated on the ordinate)

In this way, according to this embodiment, the degradation of color purity due to reflection of an electron beam is very small, as shown in FIG. 5. FIG. 5 is a diagram showing the relationship between a ratio of width/slit pitch at the flat portion 6*a* on the panel side, of tape 6 (indicated on the abscissa) and the degradation degree of chromaticity of red (indicated on the ordinate). In the related art, when the slit pitch is in the range of 0.310 to 0.221 mm, the width of the flat portion 6*a* on the panel side is set to be about 0.225 to 0.30 times the slit pitch. In this case, the degradation degree of chromaticity of red is in a range of 20/1000 to 15/1000 on the X-axis of CIE chromaticity coordinates.

On the contrary, according to this embodiment, by setting the width of the flat portion 6*a* on the panel side of tape 6 to be 0.215 or less times the slit pitch, the degradation degree of chromaticity of red can be reduced to a value of 10/1000 or less on the X-axis of CIE chromaticity coordinates.

In addition, it is known that if the width of the flat portion 6*a* on the panel side of tape 6 is set to be 0.05 or less times the slit pitch, there occurs an inconvenience resulting from the excessively small width of the flat portion 6*a* on the panel side, for example, twisting of tape 6. Accordingly, the width of the flat portion 6*a* on the panel side of the tape 6 should be set to be 0.215 times the slit pitch or less and 0.05 times the slip pitch or more.

[Second Embodiment]

The second embodiment of the present invention has the same configuration as that of the first embodiment except that a color selection electrode having a slit pitch of 0.220 to 0.100 mm is used and the width of the flat portion on the panel side of each tape is set to be 0.220 to 0.050 times the slit pitch; therefore, the second embodiment is not shown.

It is confirmed that the second embodiment exhibits the effect of reducing the degradation degree of color purity like the first embodiment.

[Third Embodiment]

The third embodiment of the present invention is characterized in that the ratio of the width of the flat portion on the panel side of each of the tapes of a color selection electrode at a central portion of a screen to the width of the flat portion at each end of the screen is 1:1.5–0.3, and the width of the flat portion is gradually changed from the central portion of the screen to each end of the screen, whereby the color purity becomes even over the screen.

As described above, the electron beam 9 emitted from an electron gun passes through one slit 7 of the color selection electrode 2, and part of the electron beam 9 is reflected from the aluminum film 10 and the phosphor 3; and, it is known that the reflectance of the electron beam differs depending on the tilt angle at which the electron beam 9 collides with the aluminum film 10 and the phosphor 3, and, more specifically, the reflectance of the electron beam 9 becomes larger as the above tilt angle becomes larger. On the other hand, the tilt angle at which the electron beam collides with the aluminum film 10 and the phosphor 3 differs between the central portion of the screen of the color cathode-ray tube and the right and left sides thereof. As a result, there occurs unevenness of the color purity due to the difference in reflectance among positions in the horizontal scanning direction on the screen.

The present inventor has found that the evenness of the color impurity on the screen can be obtained by suitably changing the width of the flat portion 6*a* on the panel side of each tape of the color-selection electrode in accordance with the tilt angle at which an electron beam collides with the aluminum film 10 and the phosphor 3. As the result of examining the change in width of the flat portion 6*a* on the panel side of each tape of the related art color selection electrode depending on the position on the horizontal scanning direction, it was found that the above width is changed as shown by the data ("related art") in FIG. 6.

Figure 6:
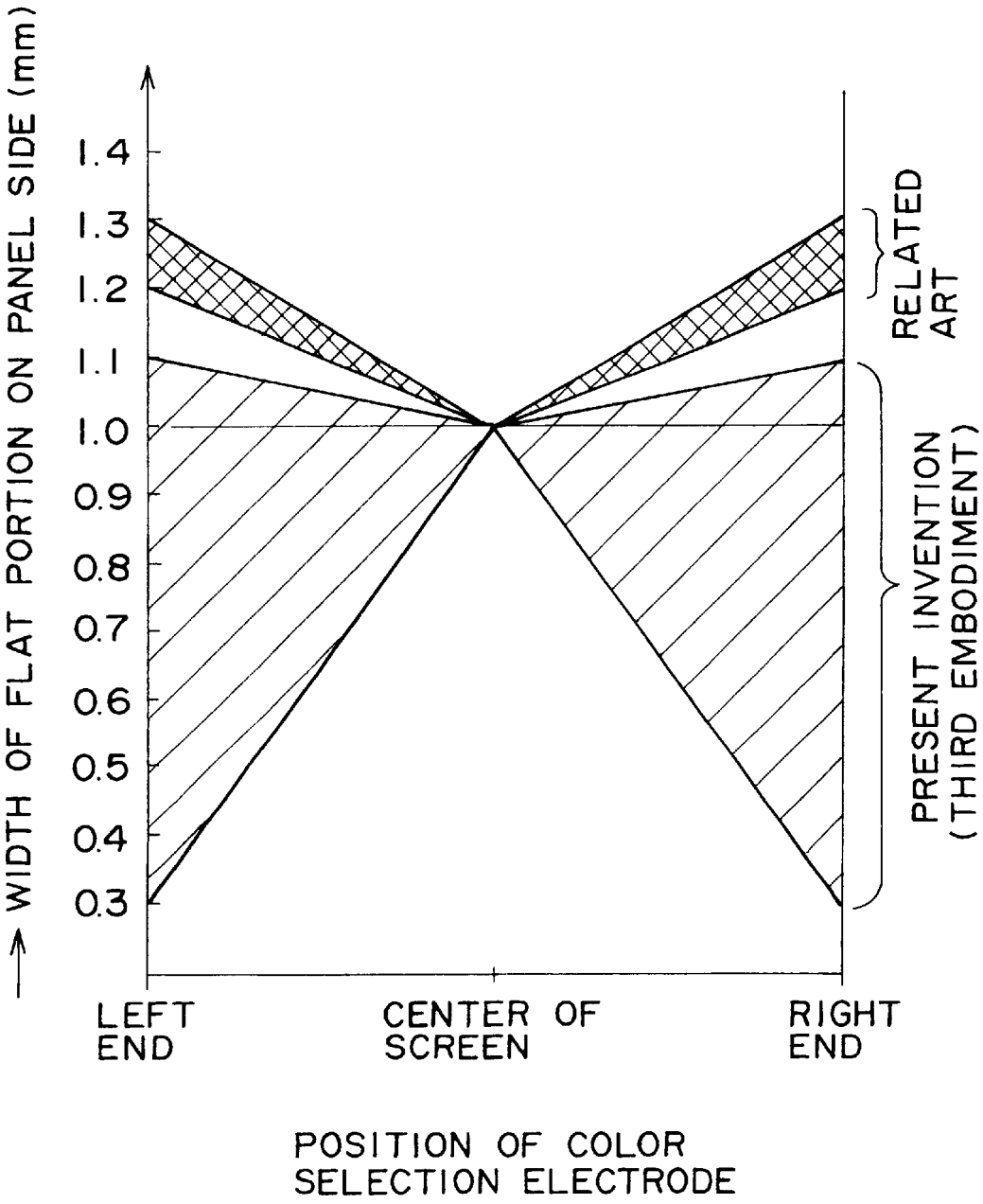
FIG. 6 is a diagram showing the relationship between the position in the horizontal scanning direction (indicated on the abscissa) and the width of the flat portion, on the panel side of each tape (indicated on the ordinate), which relationship is obtained for the color-selection electrode of each of the related art and the third embodiment of the present invention.

The present inventor has repeatedly made experiments and found that the evenness of the color purity can be significantly enhanced by changing the above width as shown by the data ("present invention (third embodiment)") in FIG. 6. The present inventor has obtained, on the basis of such a knowledge, the configuration that the ratio of the width of the flat portion on the panel side of each of the tapes of a color selection electrode at the central portion of a screen to the width of the flat portion at each end of the screen is 1:1.5–0.3, and the width of the flat portion is gradually changed from the central portion of the screen to each end of the screen. In addition, it is known that if the above ratio is 1:0.3 or less, that is, the width at each side of the screen is set to be 0.3 or less times the width at the central portion of the screen, there occurs an inconvenience resulting from the excessively small width of the flat portion 6*a* on the panel side, for example, twisting of tape 6.

In this way, according to this embodiment, it is possible to enhance the evenness of color purity.

The color-selection mechanism using the color selection electrode 2 described in each embodiment is used in the form of being assembled in a color cathode-ray tube; and, the color cathode-ray tube using the color selection electrode 2 can exhibit the same effect as described above.

According to the first embodiment, since the width of the flat portion on the panel side of each tape is set to be 0.215 to 0.050 times the slit pitch, which is narrower than that in the related art, the amount of reflection of the electron beam from the flat portion on the panel side of the tape to an undesired phosphor becomes correspondingly smaller than that in the related art. As a result, it is possible to reduce the color purity.

According to the second embodiment, since the width of the flat portion on the panel side of each tape is set to be 0.220 to 0.050 times the slit pitch, which is narrower than that in the related art, the amount of reflection of the electron beam, which has been reflected from the inner surface of the panel, from the flat portion on the panel side of the tape to an undesired phosphor becomes correspondingly smaller than that in the related art. As a result, it is possible to reduce the color purity.

According to the third embodiment, since the distribution of widths of the flat portions on the panel side of the tapes in the horizontal scanning direction of the screen conforms to the distribution indicated by the "present invention (third embodiment)" (FIG. 6 ) in which the evenness of color purity can be significantly enhanced, it is possible to significantly enhance the evenness of color purity.

While the preferred embodiments have been described using the specific terms, such description is for illustrative purposes only, and it is to be understood that changes and variations may be made without departing from the spirit or scope of the following claims.

What is claimed is:

1. A color-selection mechanism comprising:

an aperture-grill type, color-selection electrode which includes tapes constituting the matrix of said electrode and slits that are disposed between said tapes, the arranged pitch of said slits being in a range of 0.310 to 0.221 mm, wherein the width of the flat portion, on the panel side of each tape of said color selection electrode is set to be 0.215 to 0.050 times the slit pitch.

2. A color cathode-ray tube comprising:

a color-selection mechanism using an aperture-grill type color selection electrode which includes tapes constituting the matrix of said electrode and slits that are disposed between said tapes, the arranged pitch of said slits being in a range of 0.310 to 0.221 mm, wherein the width of the flat portion on the panel side of each tape of said color selection electrode is set to be 0.215 to 0.050 times the slit pitch.

3. A color selection mechanism comprising:

an aperture-grill type, color-selection electrode which includes tapes constituting the matrix of said electrode and slits that are disposed between said tapes, the arranged pitch of said slits being in a range of 0.220 to 0.100 mm, wherein the width of the flat portion, on the panel side of each tape of said color selection electrode is set to be 0.225 to 0.050 times the slit pitch.

4. A color cathode-ray tube comprising:

a color-selection mechanism using an aperture-grill type color selection electrode which includes tapes constituting the matrix of said electrode and slits that are disposed between said tapes, the arranged pitch of said slits being in a range of 0.220 to 0.100 mm, wherein the width of the flat portion on the panel side of each tape of said color selection electrode is set to be 0.225 to 0.050 times the slit pitch.

5. A color selection mechanism comprising:

an aperture-grill, type-color selection electrode which includes tapes constituting the matrix of said electrode and slits that are disposed between said tapes, wherein the ratio of the width of the flat portion on the panel side of each of said tapes at the central portion of the screen to the width of said flat portion at each end of the screen is 1:1.5–0.3, and the width of said flat portion is gradually changed from the central portion of the screen to each end of the screen.

6. A color cathode-ray tube comprising:

a color-selection mechanism using an aperture-grill type color-selection electrode which includes tapes constituting the matrix of said electrode and slits that are disposed between said tapes, wherein the ratio of the width of the flat portion on the panel side of each of said tapes of the color selection electrode at the central portion of the screen to the width of said flat portion at each end of the screen is 1:1.5–0.3, and the width of said flat portion is gradually changed from the central portion of the screen to each end of the screen.

* * * * *